US007045487B2

(12) United States Patent
Geuens et al.

(10) Patent No.: US 7,045,487 B2
(45) Date of Patent: May 16, 2006

(54) TONING AGENTS FOR USE IN SUBSTANTIALLY LIGHT-INSENSITIVE RECORDING MATERIALS

(75) Inventors: Ingrid Geuens, Emblem (BE); Johan Loccufier, Zwijnaarde (BE); Vera Drieghe, Kontich (BE)

(73) Assignee: AGFA Gevaert, Mortsel (BE)

( * ) Notice: Subject to any disclaimer, the term of this patent is extended or adjusted under 35 U.S.C. 154(b) by 203 days.

(21) Appl. No.: 10/739,241

(22) Filed: Dec. 18, 2003

(65) Prior Publication Data

US 2004/0131982 A1 Jul. 8, 2004

Related U.S. Application Data

(60) Provisional application No. 60/440,429, filed on Jan. 16, 2003.

(30) Foreign Application Priority Data

Dec. 19, 2002 (EP) ..... 02102832

(51) Int. Cl.
*B41M 5/30* (2006.01)

(52) U.S. Cl. ..... 503/212; 503/208

(58) Field of Classification Search ..... 503/227, 503/209, 212

See application file for complete search history.

(56) References Cited

U.S. PATENT DOCUMENTS

| | | | |
|---|---|---|---|
| 3,080,254 | A | 3/1963 | Grant, Jr. |
| 3,418,131 | A | 12/1968 | Bigelow |
| 3,433,640 | A | 3/1969 | Nishio et al. |
| 3,620,749 | A | 11/1971 | Haist et al. |
| 3,666,471 | A | 5/1972 | Ohyama et al. |
| 3,702,246 | A | 11/1972 | Ohyama et al. |
| 3,885,967 | A | 5/1975 | Sashihara et al. |
| 3,893,860 | A | 7/1975 | Sutton et al. |
| 3,951,660 | A | 4/1976 | Hagemann et al. |
| 4,451,561 | A | 5/1984 | Hirabayashi et al. |
| 6,479,227 | B1 | 11/2002 | Kubo et al. |

FOREIGN PATENT DOCUMENTS

| | | |
|---|---|---|
| EP | 0 752 616 A1 | 1/1997 |
| EP | 1 191 394 A2 | 3/2002 |
| GB | 1 101 927 | 2/1968 |
| JP | 07-306492 | 11/1995 |
| JP | 11 202444 A | 7/1999 |

OTHER PUBLICATIONS

Brinkman et al; *Unconventional Imaging Processes,* New York & London: The Focal Press, pp. 74-75 (1978).

Sturge et al. (eds.); *Imaging Processes and Materials,* Neblette's eighth ed., New York: Van Nostrand Reinhold, Chapter 9 (1989).

Zou et al.; *J. Imaging Sci. & Tech.,* 40(2), 94-103 (Mar./Apr. 1996).

Search Report for EP 02 10 2832 (Jun. 3, 2003).

*Primary Examiner*—Bruce H. Hess
(74) *Attorney, Agent, or Firm*—Leydig, Voit & Mayer, Ltd

(57) ABSTRACT

A black and white monosheet substantially light-insensitive thermographic recording material comprising a support and a thermosensitive element, the thermosensitive element containing a substantially light-insensitive organic silver salt, an organic reducing agent therefor in thermal working relationship therewith, a binder and at least one toning agent, wherein the at least one toning agent is selected from compounds represented by formula (I):

(I)

wherein $R^1$ is an alkyl group optionally substituted with a hydroxy, carboxy, carboxy ester, acyl or carbonato group; X is S, O or N—$R^6$; $R^6$ is an optionally substituted alkyl group; $R^2$, $R^3$, $R^4$ and $R^5$ independently represent a hydrogen atom, a halogen atom or an alkyl, an alkoxy, a thio-alkoxy, a nitro, a cyano, a carboxy, a carboxy ester, an acyl, an aldehyde, an acylamido, a sulphonamido, an acylamino, a carbonato, a hydroxy or an aryl group or at least one of $R^2$ and $R^3$, $R^3$ and $R^4$ and $R^4$ and $R^5$ independently represent the atoms necessary to form a carbocyclic or heterocyclic group or at least one of $R^1$ and $R^5$ and $R^2$ and $R^6$ independently represent the atoms necessary to form a heterocyclic ring; and compounds represented by formula (II):

(II)

wherein $R^7$ is an optionally substituted alkyl group; Y is S, O or N—$R^{10}$; $R^{10}$ is an optionally substituted alkyl group; $R^8$ and $R^9$ independently represent a hydrogen atom, a halogen atom or an alkyl, an alkoxy, a thio-alkoxy, a nitro, a cyano, a carboxy, a carboxy ester, an acyl, an aldehyde, an acylamido, a sulphonamido, an acylamino, a carbonato, a hydroxy or an aryl group or $R^8$ and $R^9$ represent the atoms necessary to form a heterocyclic or a non-aromatic carbocyclic ring or at least one of $R^8$ and $R^{10}$ and $R^9$ and $R^7$ independently represent the atoms necessary to form a heterocyclic ring; and both $R^8$ and $R^9$ cannot both be an alkyl group.

5 Claims, No Drawings

TONING AGENTS FOR USE IN SUBSTANTIALLY LIGHT-INSENSITIVE RECORDING MATERIALS

CROSS-REFERENCE TO RELATED PATENT APPLICATIONS

This application claims the benefit of U.S. Provisional Application No. 60/440,429 filed Jan. 16, 2003, which is incorporated by reference. In addition, this application claims the benefit of European Application No. 02102832.9 filed Dec. 19, 2002, which is also incorporated by reference.

FIELD OF THE INVENTION

The present invention concerns toning agents for use in substantially light-insensitive thermographic recording materials.

BACKGROUND OF THE INVENTION

Thermography is an image-forming process including a heating step and hence includes photothermography in which the image-forming process includes image-wise exposure and direct thermal processes in which the image-forming process includes an image-wise heating step. In direct thermal printing a visible image pattern is produced by image-wise heating of a recording material.

Thiazoline-2-thione and benzothiazoline-2-thione compounds are well-known as toning agents in silver halide DTR photographic materials in which they are used in a liquid developer, see for example GB 1,101,927, U.S. Pat. No. 3,433,640 and U.S. Pat. No. 3,702,246, and in silver halide photographic materials as toning agents in combination with different stabilizers, see for example U.S. Pat. Nos. 3,418,131, 3,666,471, JP 07-306492 and JP 11-202444. Furthermore, U.S. Pat. No. 3,620,749 discloses photosensitive compositions comprising silver complexes of 3-alkylbenzothiazoline-2-thiones in association with 2-mercapto-1,3,4-oxadiazole derivatives and photosensitive elements comprising such compositions.

JP 11-202444 discloses a heat-developing sensitive material characterized by containing at least one sort of compound represented by the following general formulae (1), (2) or (3):

(1)

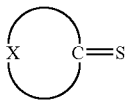

X is an atomic group necessary to form a hetero ring substituted by at least one of —$SO_3M$, —COOM, and —OM groups; X is an atomic group substituted by at least one of —$SO_3M$, —COOM, or —OM and in which heterocycle formation is possible; M represents a hydrogen atom, a metal atom, a quaternary ammonium or phosphonium group; but does not have the substructure —NH—C(═S)— in the heterocyclic structure;

(2)

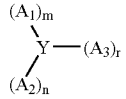

(3)

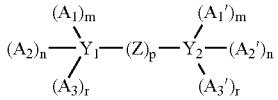

A1 and A1' represent a —$SO_3M$, —COOM, or —OM group and M represents a hydrogen atom, a metal atom, a quaternary ammonium or phosphonium group. Even if A1 and A1' are the same, they may differ; m represents an integer of 1–10; A2 and A2' represent an electron withdrawing groups, and even if A2 and A2' are the same, they may differ; n represents an integer of 1–10; each of A3 and A3' represents a functional group containing a S, Se or Te atom which may be combined with a complex ion, and even if A3 and A3' are the same, they may differ; r is 0 or 1; Y, Y1, and Y2 represent an aliphatic, aromatic or heterocyclic group; Z is an S, Se or Te atom; and p is 1 or 2.

JP 11-202444 further discloses:

I-6

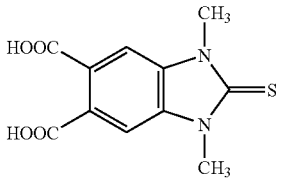

I-7

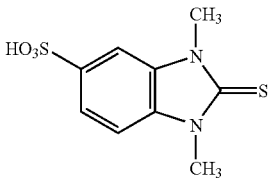

I-8

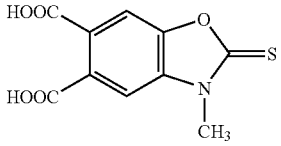

I-9

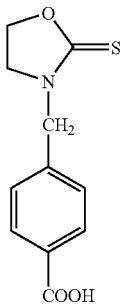

-continued

I-10

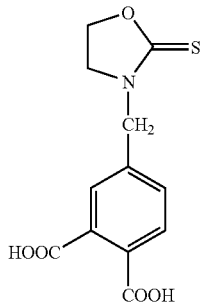

I-11

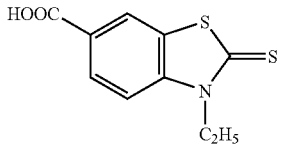

I-12

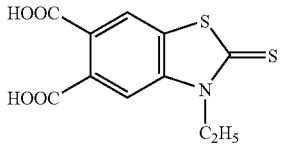

I-13

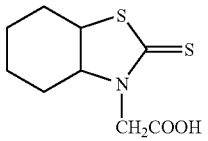

I-14

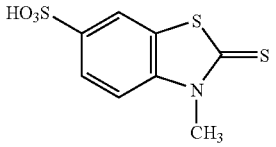

U.S. Pat. No. 4,451,561 discloses a heat-development-type recording material comprising on a support a heat-development-type image recording layer containing: (a) an organic silver salt, (b) a reducing agent, (c) a binder, and (d) at least one amido derivative of a 5-mercapto-1,3,4-triazole or a 5-mercapto-thiadiazole.

U.S. Pat. No. 3,080,254 discloses a typical heat-sensitive copy paper including in the heat-sensitive layer a thermoplastic binder, e.g ethyl cellulose, a water-insoluble silver salt, e.g. silver stearate and an appropriate organic reductor, of which 4-methoxy-1-hydroxy-dihydronaphthalene is a representative. Localized heating of the sheet in the thermographic reproduction process, or for test purposes by momentary contact with a metal test bar heated to a suitable conversion temperature in the range of about 90–150° C., causes a visible change to occur in the heat-sensitive layer. The initially white or lightly coloured layer is darkened to a brownish appearance at the heated area. In order to obtain a more neutral colour tone a heterocyclic organic toning agent such as phthalazinone is added to the composition of the heat-sensitive layer.

U.S. Pat. No. 3,885,967 discloses a photosensitive material for a thermally developable lightsensitive element, which comprises: a) a silver salt component comprising silver laurate or silver caprate, b) a catalytic amount of a photosensitive silver halide component comprising a photosensitive silver halide, or a compound which reacts with silver laurate or silver caprate to form a photosensitive silver halide, c) a reducing agent, d) a binder, and e) a toning agent comprising a compound represented by the formula:

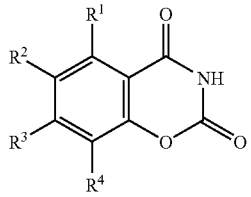

wherein $R^1$, $R^2$, $R^3$ and $R^4$ each represents a hydrogen atom, an alkyl group, an aryl group, an acylamido group, a halogen atom, a hydroxyl group or a nitro group.

EP-A 0 752 616 discloses a thermographic material comprising at least one element and wherein said element(s) contain(s) therein a substantially light-insensitive organic heavy metal salt and an organic reductor therefor, the said material being capable of thermally producing an image from said organic heavy metal salt and reductor, wherein said material contains a 1,3-benzoxazine-2,4-dione toning agent having general formula (I):

(I)

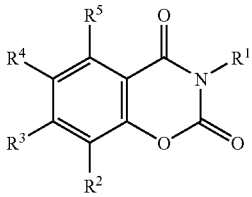

wherein $R^1$ represents hydrogen, —$CH_2OH$, —(C═O) —R, —CONHR, or M; $R^2$, $R^3$, $R^4$ and $R^5$ each independently represents hydrogen, —O— (C═O) —OR or —NH— (C═O) —OR and at least one of which is not hydrogen if $R^1$ is also hydrogen; R represents an alkyl or aryl group either of which may be substituted; and M represents a monovalent heavy metal ion.

Differences Between Thermography and Photography

The imaging arts have long recognized that the field of thermography comprising both photothermography and substantially light-insensitive thermography are clearly distinct from that of photography. Photothermographic and substantially light-insensitive thermographic materials differ significantly from conventional silver halide photographic materials, which require processing using aqueous processing solutions.

In photothermographic and substantially light-insensitive thermographic imaging materials, a visible image is created by heat as a result of the reaction of a developer incorporated within the element. Heat at 50° C. or more is essential for this development process and temperatures of over 100° C. are routinely required for photothermographic materials and still higher temperatures are routinely required for substantially light-insensitive thermographic materials. In contrast, conventional wet-processed photographic imaging elements require processing in aqueous processing baths to provide a visible image (e.g., developing and fixing baths) and development is usually performed at more moderate temperatures (e.g., 30° to 50° C.) to provide a visible image.

In photothermographic elements only a small amount of silver halide is used to capture light and a different sort of silver (e.g., silver behenate) is used to generate the image with heat. Thus imaged, the silver halide serves as a catalyst for the physical development process involving the non-photosensitive, reducible silver source and the incorporated reducing agent. In contrast, conventional wet-processed black-and-white photographic materials use only one form of silver (i.e. silver halide) that, upon chemical development, is itself converted into the silver image, or upon physical development requires addition of an external silver source (or other reducible metal ions that form black images upon reduction to the corresponding metal). Thus, photothermographic materials require an amount of silver halide per unit area that is only a fraction of that used (as little as one-hundredth) of that used in a conventional wet-processed photographic material.

Moreover, in photothermographic systems, all of the "chemistry" for imaging is incorporated within the material itself. For example, such materials include a developer (i.e. a reducing agent for the reducible silver ions) while photographic materials usually do not. Even in so-called "instant photography", the developer chemistry is physically separated from the photosensitive silver halide until development is desired. The incorporation of the developer into substantially light-insensitive thermographic and photothermographic materials can lead to the increased formation of various types of "fog" or other undesirable sensitometric side effects. Therefore, much effort has gone into the preparation and manufacture of substantially light-insensitive thermographic and photothermographic materials to minimize these problems during the preparation of the substantially light-insensitive thermographic and photothermographic dispersions as well as during coating, storage, and post-processing handling.

Moreover, in photothermographic materials, the unexposed silver halide generally remains intact after development and the material must be stabilized against further imaging and development. In contrast, silver halide is removed from conventional photographic materials after solution development to prevent further imaging (i.e. in the aqueous fixing step).

In photothermographic and substantially light-insensitive thermographic materials, the binder is capable of wide variation and a number of binders (both hydrophilic and hydrophobic) are useful. In contrast, conventional photographic materials are limited almost exclusively to hydrophilic binders such as gelatin.

Because photothermographic and substantially light-insensitive thermographic elements require thermal processing, they pose different considerations and present distinctly different problems in manufacture and use, compared to conventional wet-processed silver halide photographic materials. Additives that have one effect in conventional silver halide photographic materials may behave quite differently when incorporated in substantially light-insensitive thermographic or photothermographic materials where the underlying chemistry is significantly more complex. The incorporation of such additives as, for example, stabilizers, antifoggants, speed enhancers, sensitizers, supersensitizers and spectral and chemical sensitizers in conventional photographic materials is not predictive of whether such additives will prove beneficial or detrimental in substantially light-insensitive thermographic or photothermographic materials. For example, it is not uncommon for a photographic antifoggant useful in conventional photographic materials to cause various types of fog when incorporated into substantially light-insensitive thermographic or photothermographic materials, or for supersensitizers that are effective in photographic materials to be inactive in photothermographic materials.

These and other distinctions between photothermographic and substantially light-insensitive thermographic materials and photographic materials are described in *Imaging Processes and Materials* (Neblette's Eighth Edition); J. Sturge et al, Ed; Van Nostrand Rheinhold: New York, 1989; Chapter 9 and in *Unconventional Imaging processes*; E. Brinckman et al., Ed: The Focal Press: London and New York: 1978: pp. 74–75, and in Zou, Sahyun, Levy and Serpone, *J. Imaging Sci. Technol*. 1996, 40, pp. 94–103.

Differences between substantially light-insensitive thermographic recording materials and photothermographic recording materials The technology of substantially light-insensitive thermographic materials in which image formation is based on the reduction of organic silver salts is significantly different from that of photothermographic recording materials, despite the fact that in both cases the image results from the reduction of organic silver salts. However, this a superficial similarity masking the fact that the realization of the species which catalyze this reduction is completely different, being image-wise exposure of photosensitive silver halide-containing photo-addressable thermally developable elements in the case of photothermographic recording materials and image-wise heating of thermosensitive elements which do not contain photosensitive silver halide in the case of thermographic recording materials. This difference in technology is further underlined by the nature of the ingredients used in the two types of materials, the most significant difference being the absence of photosensitive silver halide and spectral sensitizing agents in substantially light-insensitive thermographic recording materials, but also reflected in the different reducing agents used, stronger reducing agents being used in substantially light-insensitive thermographic recording materials, the different stabilizers, the different toning agents etc. Furthermore, the thermal development processes themselves are significantly different in that the whole material is heated at temperatures of less than 150° C. for periods of seconds (e.g. 10s) in the case of photothermographic recording materials, whereas in the case of substantially light-insensitive thermographic recording materials the materials are image-wise heated at much higher temperatures for periods of ms (e.g. 10–20 ms). Realization of a neutral image tone is a major problem in the case of substantially light-insensitive thermographic recording materials due to the very short heating times, whereas it is much less of a problem in photothermographic recording materials due to the much longer heating times.

Problem to be Solved

Substantially light-insensitive thermographic recording materials with prior art toning agents exhibit poor storage properties, as is the case with e.g. phthalazinone, and/or an image colour which has an insufficiently neutral tone for black and white images, as is the case with e.g. succinimide, phthalimide, phthalic acid and phthalazine. The use of 3,4-dihydro-2,4-dioxo-1,3,2H-benzoxazine as a toning agent in thermographic materials, as disclosed in U.S. Pat. No. 3,951,660, represented an improvement in storage properties and in the neutrality of the image tone, whether substituted, as disclosed in U.S. Pat. No. 3,885,967 and U.S. Pat. No. 3,951,660, or unsubstituted, as disclosed in U.S. Pat. No. 3,951,660. Such toning agents are insufficiently soluble in ecologically acceptable coating solvents and thermographic materials containing these toning agents exhibit a undesirably strong deterioration in image colour and an undesirable increase in image background (fog) upon storage. Furthermore, such toning agents diffuse through the thermographic materials to the thermal head resulting in cloudiness in the imaging material, deposits of ingredients and by-products from the image-forming process on the surface of the thermographic material and, in the case of substantially light-insensitive thermographic materials in thermal head printers, image degradation due to thermal head contamination.

ASPECTS OF THE INVENTION

It is therefore an aspect of the present invention to provide toning agents for use in substantially light-insensitive thermographic recording materials suitable for use in thermographic printers without adverse effect on the image tone.

Further aspects and advantages of the invention will become apparent from the description hereinafter.

SUMMARY OF THE INVENTION

It has been surprisingly found that compounds according to formulae (I) and (II), which adsorb particularly rapidly on silver nano-particles as demonstrated by time-resolved SERS measurements and bring about rapid aggregation thereof, render the image tone of thermographic materials more neutral in thermographic materials, whose image-forming process is based upon the image-wise reduction of substantially light-insensitive organic silver salts i.e. exhibit so-called toning properties. Moreover, it has been surprisingly found that in a particular binder matrix a combination of toning agents both exhibiting rapid adsorption on silver nano-particles and capable of bringing about rapid aggregation thereof, but exhibiting slow and fast diffusion respectively in the particular polymer matrix, exhibit favourable synergistic effects with respect to image tone and diffusion thereof to the surface of the thermographic materials.

Aspects of the present invention are realized with a black and white monosheet thermographic recording material comprising a support and a thermosensitive element, the thermosensitive element containing a substantially light-insensitive organic silver salt, an organic reducing agent therefor in thermal working relationship therewith, a binder and at least one toning agent, wherein the at least one toning agent is selected from compounds represented by formula (I):

(I)

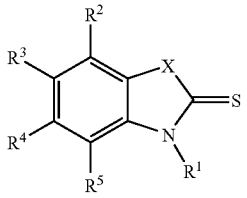

wherein $R^1$ is an alkyl group optionally substituted with a hydroxy, carboxy, carboxy ester, acyl or carbonato group; X is S, O or N—$R^6$; $R^6$ is an optionally substituted alkyl group; $R^2$, $R^3$, $R^4$ and $R^5$ independently represent a hydrogen atom, a halogen atom or an alkyl, an alkoxy, a thio-alkoxy, a nitro, a cyano, a carboxy, a carboxy ester, an acyl, an aldehyde, an acylamido, a sulphonamido, an acylamino, a carbonato, a hydroxy or an aryl group or at least one of $R^2$ and $R^3$, $R^3$ and $R^4$ and $R^4$ and $R^5$ independently represent the atoms necessary to form a carbocyclic or heterocyclic group or at least one of $R^1$ and $R^5$ and $R^2$ and $R^6$ independently represent the atoms necessary to form a heterocyclic ring; and compounds represented by formula (II):

(II)

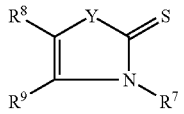

wherein $R^7$ is an optionally substituted alkyl group; Y is S, O or N—$R^{10}$; $R^{10}$ is an optionally substituted alkyl group; $R^8$ and $R^9$ independently represent a hydrogen atom, a halogen atom or an alkyl, an alkoxy, a thio-alkoxy, a nitro, a cyano, a carboxy, a carboxy ester, an acyl, an aldehyde, an acylamido, a sulphonamido, an acylamino, a carbonate, a hydroxy or an aryl group or $R^8$ and $R^9$ represent the atoms necessary to form a heterocyclic or a non-aromatic carbocyclic ring or at least one of $R^8$ and $R^{10}$ and $R^9$ and $R^7$ independently represent the atoms necessary to form a heterocyclic ring; and both $R^8$ and $R^9$ cannot both be an alkyl group.

Preferred embodiments of the present invention are disclosed in the detailed description of the invention.

DETAILED DESCRIPTION OF THE INVENTION

Definitions

The term thermographic material as used in disclosing the present invention includes both photothermographic materials and substantially light-insensitive thermographic materials.

The term alkyl means all variants possible for each number of carbon atoms in the alkyl group i.e. for three carbon atoms: n-propyl and isopropyl; for four carbon atoms: n-butyl, isobutyl and tertiary-butyl; for five carbon atoms: n-pentyl, 1,1-dimethyl-propyl, 2,2-dimethylpropyl and 2-methyl-butyl etc.

The term acyl group as used in disclosing the present invention means —(C═O)-aryl and —(C═O)-alkyl groups.

The term carbocyclic ring includes both alicylic rings and aromatic rings.

Substantially light-insensitive means not intentionally light sensitive.

The L*, a* and b* CIELAB-values are defined in ASTM Norm E179-90 in a R(45/0) geometry with evaluation according to ASTM Norm E308-90 and have been used to characterize the image tone of thermographic materials of the present invention.

Heating in association with the expression a substantially water-free condition as used herein, means heating at a temperature of 80 to 250° C. The term "substantially water-free condition" as used herein means that the reaction system is approximately in equilibrium with water in the air, and water for inducing or promoting the reaction is not particularly or positively supplied from the exterior to the element. Such a condition is described in T. H. James, "The Theory of the Photographic Process", Fourth Edition, Macmillan 1977, page 374.

Thermosensitive Element

The term thermosensitive element as used herein is that element which contains all the ingredients, which contribute to image formation. According to the present invention, the thermosensitive element contains one or more substantially light-insensitive organic silver salts, one or more reducing agents therefor in thermal working relationship therewith and a binder. The element may comprise a layer system in which the above-mentioned ingredients may be dispersed in different layers, with the proviso that the substantially light-insensitive organic silver salts are in reactive association with the reducing agents i.e. during the thermal development process the reducing agent must be present in such a way that it is able to diffuse to the particles of substantially light-insensitive organic silver salt so that reduction to silver can occur. Such materials include the possibility of one or more substantially light-insensitive organic silver salts and/or one of more organic reducing agents therefor being encapsulated in heat-responsive microcapsules, such as disclosed in EP-A 0 736 799 herein incorporated by reference.

Toning Agent

Aspects of the present invention are realized with a black and white monosheet substantially light-insensitive recording material comprising a support and a thermosensitive element, the thermosensitive element containing a substantially light-insensitive organic silver salt, an organic reducing agent therefor in thermal working relationship therewith, a binder and at least one toning agent, wherein the at least one toning agent is selected from compounds represented by formula (I):

(I)

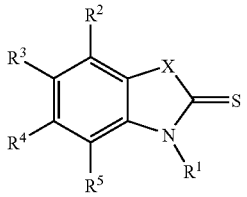

wherein $R^1$ is an alkyl group optionally substituted with a hydroxy, carboxy, carboxy ester, acyl or carbonate group; X is S, O or N—$R^6$; $R^6$ is an optionally substituted alkyl group; $R^2$, $R^3$, $R^4$ and $R^5$ independently represent a hydrogen atom, a halogen atom or an alkyl, an alkoxy, a thio-alkoxy, a nitro, a cyano, a carboxy, a carboxy ester, an acyl, an aldehyde, an acylamido, a sulphonamido, an acylamino, a carbonato, a hydroxy or an aryl group or at least one of $R^2$ and $R^3$, $R^3$ and $R^4$ and $R^4$ and $R^5$ independently represent the atoms necessary to form a carbocyclic or heterocyclic group or at least one of $R^1$ and $R^5$ and $R^2$ and $R^6$ independently represent the atoms necessary to form a heterocyclic ring; and compounds represented by formula (II):

(II)

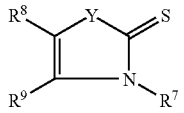

wherein $R^7$ is an optionally substituted alkyl group; Y is S, O or N—$R^{10}$; $R^{10}$ is an optionally substituted alkyl group; $R^8$ and $R^9$ independently represent a hydrogen atom, a halogen atom or an alkyl, an alkoxy, a thio-alkoxy, a nitro, a cyano, a carboxy, a carboxy ester, an acyl, an aldehyde, an acylamido, a sulphonamido, an acylamino, a carbonato, a hydroxy or an aryl group or $R^8$ and $R^9$ represent the atoms necessary to form a heterocyclic or a non-aromatic carbocyclic ring or at least one of $R^8$ and $R^{10}$ and $R^9$ and $R^7$ independently represent the atoms necessary to form a heterocyclic ring; and both $R^8$ and $R^9$ cannot both be an alkyl group.

Suitable optional substituents for the alkyl groups of $R^1$, $R^6$, $R^7$ and $R^{10}$ independently include carboxy ester groups and preferably exclude exclude carboxy, sulfo and hydroxy groups. Suitable substituted alkyl groups include: —$CH_2COOH$, —$C_2H_4COOH$ and —$C_2H_4COOC_2H_5$.

According to a second embodiment of the black and white monosheet substantially light-insensitive recording material, according to the present invention, $R^2$, $R^3$, $R^3$ and $R^4$ independently represent a hydrogen atom, a halogen atom or an alkyl, an alkoxy, a thio-alkoxy, a nitro, a cyano, a carboxy ester, an acyl, an aldehyde, an acylamido, a sulphonamido, an acylamino, a carbonato or an aryl group or at least one of $R^2$ and $R^3$, $R^3$ and $R^4$ and $R^4$ and $R^5$ independently represent the atoms necessary to form a carbocyclic or heterocyclic group or at least one of $R^1$ and $R^5$ and $R^2$ and $R^6$ independently represent the atoms necessary to form a heterocyclic ring.

According to a third embodiment of the black and white monosheet substantially light-insensitive recording material, according to the present invention, $R^8$ and $R^9$ independently represent a hydrogen atom, a halogen atom or an alkyl, an alkoxy, a thio-alkoxy, a nitro, a cyano, a carboxy ester, an acyl, an aldehyde, an acylamido, a sulphonamido, an acylamino, a carbonato or an aryl group or $R^8$ and $R^9$ represent the atoms necessary to form a heterocyclic or a non-aromatic carbocyclic ring or at least one of $R^8$ and $R^{10}$ and $R^9$ and $R^7$ independently represent the atoms necessary to form a heterocyclic ring; and both $R^8$ and $R^9$ cannot both be an alkyl group.

According to a fourth embodiment of the black and white monosheet substantially light-insensitive recording material, according to the present invention, the thermosensitive element further contains at least one toning agent selected from the group consisting of phthalazinone, phthalazinone derivatives, pyridazone, pyridazone derivatives, benzoxazine dione, benzoxazine dione derivatives, naphthoxazine dione and naphthoxazine dione derivatives.

The synergetic effect of a combination of two toning agents, according to the present invention, or one toning agent according to the present invention, together with a further toning agent, such as benzoxazine dione, a benzoxazine dione derivative, phthalazinone, a phthalazinone derivative, pyridazone or a pyridazone derivative, in obtaining a more neutral image tone than would be expected by additive combination of the image tone obtained with the toning agents separately may, we believe, be due to combining toning agents which exhibit good silver nanoparticle-aggregating properties but have very different diffusion coefficients.

According to a fifth embodiment of the black and white monosheet substantially light-insensitive recording material, according to the present invention, the thermosensitive element contains at least two toning agents with a diffusion in the binder differing by at least a factor of 2, but less than a factor of 1000 and preferably by at least a factor of 10.

According to a sixth embodiment of the black and white monosheet substantially light-insensitive recording material, according to the present invention, in the compound(s) represented by formula (I) $R^1$ is $—CH_2COOR^{11}$ or $—CH_2CH_2COOR^{11}$, where $R^{11}$ is hydrogen or an alkyl group.

According to a seventh embodiment of the black and white monosheet substantially light-insensitive recording material, according to the present invention, the compound(s) represented by formula (I) is (are) selected from the group consisting of:

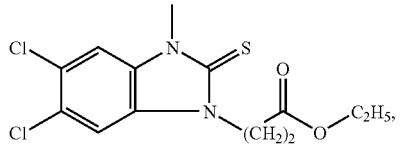

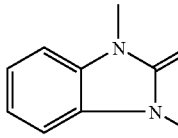

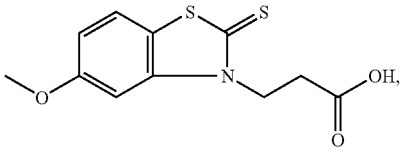

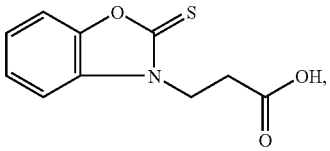

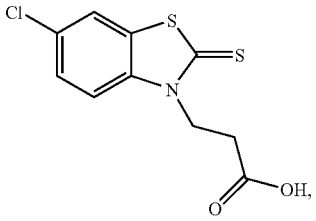

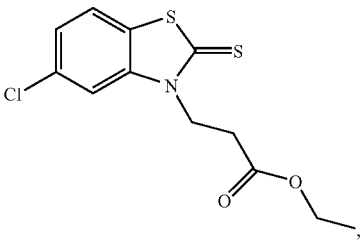

-continued

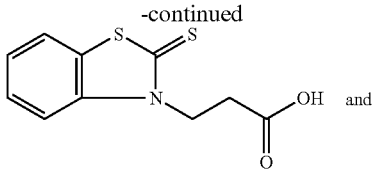

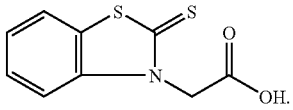

According to an eighth embodiment of the black and white monosheet substantially light-insensitive recording material, according to the present invention, in the compound(s) represented by formula (II) $R^7$ is $—CH_2COOH$ or $—CH_2CH_2COOH$.

According to a ninth embodiment of the black and white monosheet substantially light-insensitive recording material, according to the present invention, the compound(s) represented by formula (II) is (are) selected from the group consisting of:

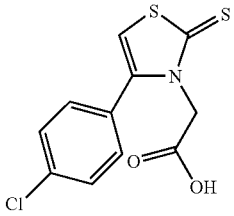

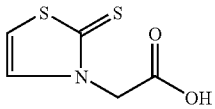

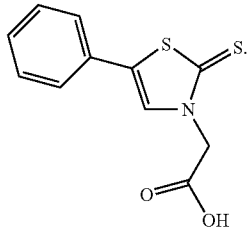

According to a tenth embodiment of the black and white monosheet substantially light-insensitive recording material, according to the present invention, the thermosensitive element further contains at least one toning agent selected from the group consisting of benzo[e][1,3]oxazine-2,4-dione, 7-methyl-benzo[e][1,3]oxazine-2,4-dione, 7-methoxy-benzo[e][1,3]oxazine-2,4-dione, 7-butoxy-benzo[e][1,3]oxazine-2,4-dione, 7-(ethylcarbonato)-benzo[e][1,3]oxazine-2,4-dione,

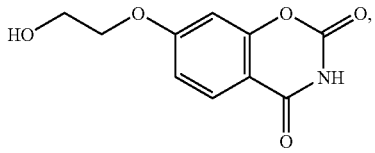

-continued
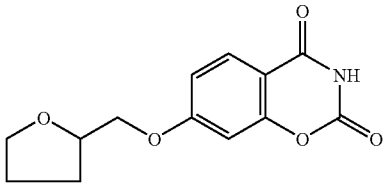
and
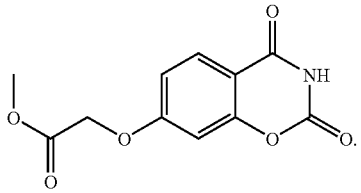
Suitable toning agents represented by formula (I) according to the present invention include:
| toning agent number | |
|---|---|
| TA-I-1 | 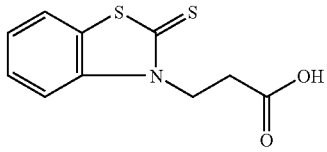 |
| TA-I-2 | 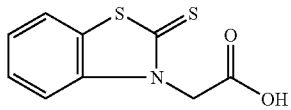 |
| TA-I-3 | 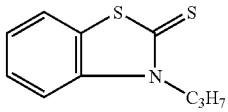 |
| TA-I-4 | 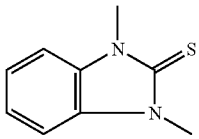 |
| TA-I-5 | 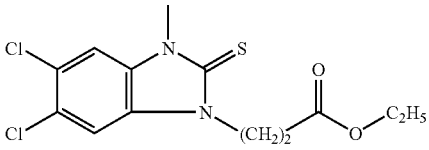 |
| TA-I-6 | 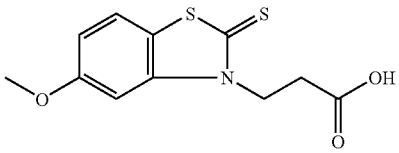 |
| TA-I-7 | 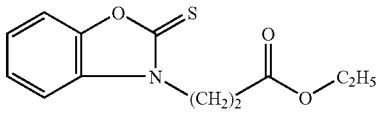 |
-continued
| toning agent number | |
|---|---|
| TA-I-8 | 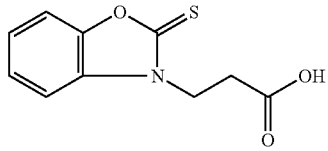 |
| TA-I-9 | 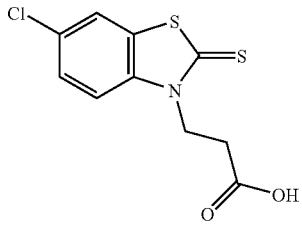 |
| TA-I-10 | 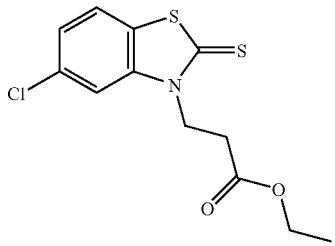 |
| TA-I-11 | 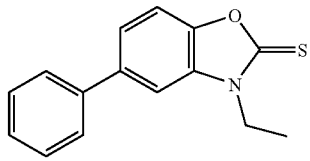 |
Suitable toning agents represented by formula (II) according to the present invention include:
| toning agent number | |
|---|---|
| TA-II-1 | 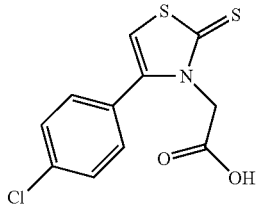 |
| TA-II-2 | 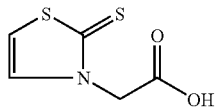 |

-continued

| toning agent number | |
|---|---|
| TA-II-3 | 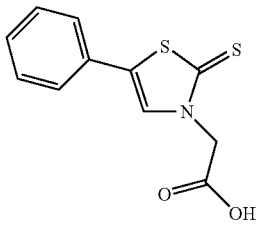 |
| TA-II-4 | 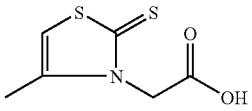 |
| TA-II-5 | 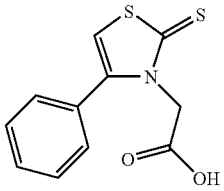 |
| TA-II-6 | 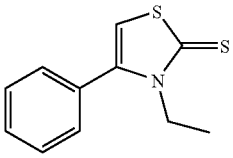 |
| TA-II-7 | 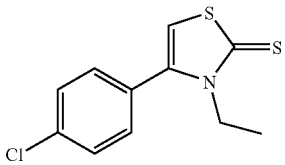 |

Organic Silver Salt

According to an eleventh embodiment of the black and white monosheet substantially light-insensitive recording material of the present invention, the organic silver salts are not double organic salts containing a silver cation associated with a second cation e.g. magnesium or iron ions.

According to a twelfth embodiment of the black and white monosheet substantially light-insensitive recording material of the present invention, at least one of the organic silver salts is a substantially light-insensitive silver salt of an organic carboxylic acid.

According to a thirteenth embodiment of the black and white is monosheet substantially light-insensitive recording material of the present invention, at least one of the organic silver salts is a substantially light-insensitive silver salt of an aliphatic carboxylic acids known as a fatty acid, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Other silver salts of an organic carboxylic acid as described in GB-P 1,439,478, e.g. silver benzoate, may likewise be used to produce a thermally developable silver image. Combinations of different silver salt of an organic carboxylic acids may also be used in the present invention, as disclosed in EP-A 964 300.

Organic silver salts may be dispersed by standard dispersion techniques. Ball mills, bead mills, microfluidizers, ultrasonic apparatuses, rotor stator mixers etc. have been found to be useful in this regard. Mixtures of organic silver salt dispersions produced by different techniques may also be used to obtain the desired thermographic properties e.g. of coarser and more finely ground dispersions of organic silver salts.

Reducing Agents

According to a fourteenth embodiment of the black and white substantially light-insensitive recording material, according to the present invention, the reducing agent is an organic compound containing at least one active hydrogen atom linked to O, N or C, such as is the case with, aromatic di- and tri-hydroxy compounds. 1,2-dihydroxy-benzene derivatives, such as catechol, 3-(3,4-dihydroxyphenyl) propionic acid, 1,2-dihydroxybenzoic acid, gallic acid and esters e.g. methyl gallate, ethyl gallate, propyl gallate and 3,4-dihydroxy-benzoic acid esters are preferred, with those described in EP-A 0 692 733, EP-A 0 903 625, EP-A 1 245 403 and EP-A 1 245 404 herein incorporated by reference being particularly preferred e.g. ethyl 3,4-dihydroxybenzoate, n-butyl 3,4-dihydroxybenzoate, 3,4-dihydroxy-benzaldehyde, 3,4-dihydroxy-acetophenone, 3,4-butyrophenone, 3,4-dihydroxy-benzophenone, 3,4-dihydroxybenzophenone derivatives, 3,4-dihydroxy-benzonitrile, and tannic acid.

Combinations of reducing agents may also be used that on heating become reactive partners in the reduction of the one or more substantially light-insensitive organic silver salt. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents as disclosed in U.S. Pat. No. 5,545,505, U.S. Pat. No. 5,545,507 and U.S. Pat. No. 5,558,983; acrylonitrile compounds as disclosed in U.S. Pat. No. 5,545,515 and U.S. Pat. No. 5,635,339; and 2-substituted malonodialdehyde compounds as disclosed in U.S. Pat. No. 5,654,130.

Binder of the Thermosensitive Element

The film-forming binder of the thermosensitive element may be all kinds of natural, modified natural or synthetic resins or mixtures of such resins, in which the at least one organic silver salt can be dispersed homogeneously either in aqueous or solvent media: e.g. cellulose derivatives, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylates, polymethacrylates, polystyrene and polyethylene or mixtures thereof.

Suitable water-soluble film-forming binders for use in substantially light-insensitive recording materials according to the present invention are: polyvinyl alcohol, polyacrylamide, polymethacrylamide, polyacrylic acid, polymethacrylic acid, polyvinylpyrrolidone, polyethyleneglycol, proteinaceous binders, polysaccharides and water-soluble cellulose derivatives. A preferred water-soluble binder for use in the substantially light-insensitive recording materials of the present invention is gelatine.

The binder to organic silver salt weight ratio is preferably in the range of 0.2 to 7, and the thickness of the thermosensitive element is preferably in the range of 5 to 50 μm. Binders are preferred which do not contain additives, such as certain antioxidants (e.g. 2,6-di-tert-butyl-4-methylphenol), or impurities which adversely affect the thermographic properties of the substantially light-insensitive recording materials in which they are used.

Stabilizers

According to a fifteenth embodiment of the black and white monosheet substantially light-insensitive recording material, according to the present invention, the thermosensitive element further contains a stabilizer.

According to a sixteenth embodiment of the black and white monosheet substantially light-insensitive recording material, according to the present invention, the thermosensitive element further contains a stabilizer selected from the group consisting of benzotriazole; substituted benzotriazoles; aromatic polycarboxylic acid, such as ortho-phthalic acid, 3-nitro-phthalic acid, tetrachlorophthalic acid, mellitic acid, pyromellitic acid and trimellitic acid and anhydrides thereof; 1-phenyl-5-mercaptotetrazole compounds in which the phenyl group is substituted with a substituent containing an optionally substituted aryl group, 1-(5-mercapto-1-tetrazolyl)-acetyl compounds represented by formula (III):

(III)

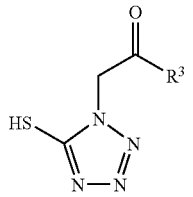

wherein $R^3$ is —$NR^4R^5$, —$OR^6$ or an optionally substituted aryl or heteroaryl group; $R^4$ is hydrogen or an optionally substituted alkyl, aryl or heteroaryl group; $R^5$ is an optionally substituted aryl or heteroaryl group; and $R^6$ is an optionally substituted aryl group; and compounds with two or more groups represented by formula (IV):

(IV)

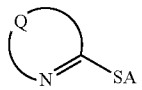

where Q comprises the necessary atoms to form a 5- or 6-membered unsaturated heterocyclic ring, A is hydrogen, a counterion to compensate the negative charge of the thiolate group or two or more A groups provide a linking group between the two or more groups represented by formula (IV).

According to a seventeeth embodiment of the black and white monosheet substantially light-insensitive recording material, according to the present invention, the thermosensitive element further contains at least one optionally substituted aliphatic or carbocyclic polycarboxylic acid and/or anhydride thereof in a molar percentage of at least 15 with respect to all the organic silver salt(s) present and in thermal working relationship therewith. The polycarboxylic acid may be used in anhydride form or partially esterified on the condition that at least two free carboxylic acids remain or are available during the heat recording step.

Surfactants and Dispersants

Surfactants and dispersants aid the dispersion of ingredients which are insoluble in the particular dispersion medium. The substantially light-insensitive substantially light-insensitive material used in the present invention may contain one or more surfactants, which may be anionic, non-ionic or cationic surfactants and/or one or more dispersants. Suitable dispersants are natural polymeric substances, synthetic polymeric substances and finely divided powders, e.g. finely divided non-metallic inorganic powders such as silica.

Support

According to a nineteenth embodiment of the black and white monosheet substantially light-insensitive recording material, according to the present invention, the support is transparent or translucent. It is preferably a thin flexible carrier made transparent resin film, e.g. made of a cellulose ester, e.g. cellulose triacetate, polypropylene, polycarbonate or polyester, e.g. polyethylene terephthalate. The support may be in sheet, ribbon or web form and subbed if needs be to improve the adherence to the thereon coated thermosensitive element. The support may be dyed or pigmented to provide a transparent coloured background for the image.

Protective Layer

According to a twentieth embodiment of the black and white monosheet substantially light-insensitive recording material, according to the present invention, the thermosensitive element is provided with a protective layer. In general this protects the thermosensitive element from atmospheric humidity and from surface damage by scratching etc. and prevents direct contact of printheads or heat sources with the recording layers. Protective layers for thermosensitive elements which come into contact with and have to be transported past a heat source under pressure, have to exhibit resistance to local deformation and good slipping characteristics during transport past the heat source during heating. A slipping layer, being the outermost layer, may comprise a dissolved lubricating material and/or particulate material, e.g. talc particles, optionally protruding from the outermost layer. Examples of suitable lubricating materials are a surface active agent, a liquid lubricant, a solid lubricant or mixtures thereof, with or without a polymeric binder.

Coating Techniques

The coating of any layer of the substantially light-insensitive substantially light-insensitive material used in the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA. Coating may proceed from aqueous or solvent media with overcoating of dried, partially dried or undried layers.

Thermographic Processing

Thermographic imaging is carried out by the image-wise application of heat either in analogue fashion by direct exposure through an image or by reflection from an image, or in digital fashion pixel by pixel either by using an infra-red heat source, for example with a Nd-YAG laser or other infra-red laser, with a substantially light-insensitive thermographic material preferably containing an infra-red absorbing compound, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The operating temperature of common thermal printheads is in the range of 300 to 400° C. and the heating time per picture element (pixel) may be less than 1.0 ms, the pressure contact of the thermal printhead with the recording material being e.g. 200–1000 g/linear cm, i.e. with a contact zone (nip) of 200 to 300 μm a pressure of 5000 to 50,000 g/cm$^2$, to ensure a good transfer of heat.

Activation of the heating elements can be power-modulated or pulse-length modulated at constant power. EP-A 654 355 discloses a method for making an image by image-wise heating by means of a thermal head having energizable heating elements, wherein the activation of the heating elements is executed duty cycled pulsewise. EP-A 622 217 discloses a method for making an image using a direct thermal imaging element producing improvements in continuous tone reproduction.

Image-wise heating of the recording material can also be carried out using an electrically resistive ribbon incorporated into the material. Image- or pattern-wise heating of the recording material may also proceed by means of pixel-wise modulated ultra-sound.

Industrial Application

Thermographic imaging can be used for the production of reflection type prints and transparencies, in particular for use in the medical diagnostic field in which black-imaged transparencies are widely used in inspection techniques operating with a light box.

The invention is illustrated hereinafter by way of comparative examples and invention examples. The percentages and ratios given in these examples are by weight unless otherwise indicated.

Subbing layer Nr. 01 on the emulsion side of the support had the composition:

| | |
|---|---|
| copolymer of 88% vinylidene chloride, 10% methyl acrylate and 2% itaconic acid | 79.1 mg/m$^2$ |
| Kieselsol ® 100 F, a colloidal silica from BAYER | 18.6 mg/m$^2$ |
| Mersolat ® H, a surfactant from BAYER | 0.4 mg/m$^2$ |
| Ultravon ® W, a surfactant from CIBA-GEIGY | 1.9 mg/m$^2$ |

Ingredients in the thermosensitive element in addition to the above-mentioned ingredients:

BL5HP = S-LEC BL5HP, a polyvinyl butyral from SEKISUI;
Oil = BAYSILON, a silicone oil from BAYER;
VL = DESMODUR VL, a 4,4'-diisocyanatodiphenylmethane from BAYER;
Reducing agents:
R01 = 3,4-dihydroxybenzonitrile;
R02 = 3,4-dihydroxybenzophenone;
Toning agents:

COMP-1

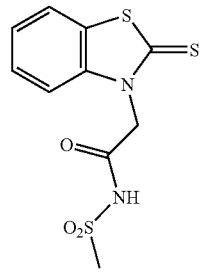

COMP-2

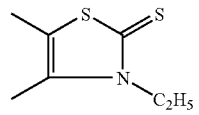

COMP-3

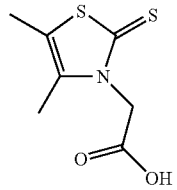

BOD01

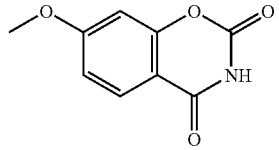

7-methoxy-benzo[e][1,3]oxazine-2,4-dione

BOD02

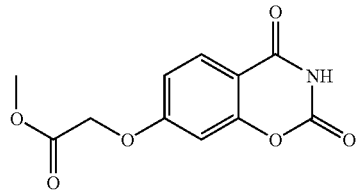

BOD03

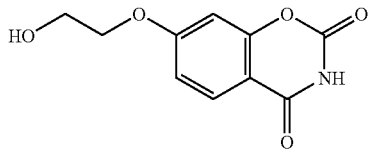

BOD04

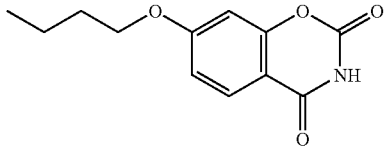

7-butoxy-benzo[e][1,3]oxazine-2,4-dione

-continued

BL5HP = S-LEC BL5HP, a polyvinyl butyral from SEKISUI;
Oil = BAYSILON, a silicone oil from BAYER;
VL = DESMODUR VL, a 4,4'-diisocyanatodiphenylmethane from BAYER;
Reducing agents:
R01 = 3,4-dihydroxybenzonitrile;
R02 = 3,4-dihydroxybenzophenone;
Toning agents:

BOD05

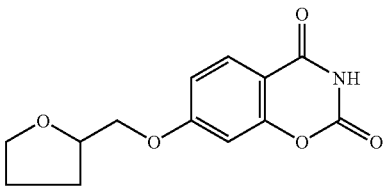

BOD06

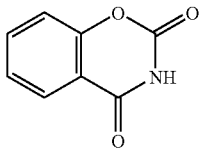

benzo[e][1,3]oxazine-2,4-dione

BOD07

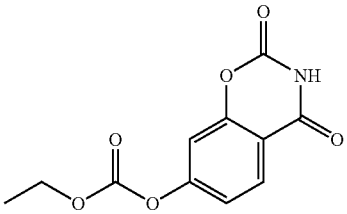

7-(ethylcarbonato)-benzo[e][1,3]oxazine-2,4-dione

Stabilizers:
S01 = glutaric acid
S02 = tetrachlorophthalic acid anhydride
S03 = benzotriazole
Ingredients in the protective layer:
ERCOL ™ 48 20 = a polyvinylalcohol from ACETEX EUROPE;
LEVASIL ™ VP AC 4055 = a 15% aqueous dispersion of colloidal silica with acid groups predominantly neutralized with sodium ions and a specific surface are of 500 $m^2/g$, from BAYER AG has been converted into the ammonium salt;
ULTRAVON ™ W = 75–85% concentrate of a sodium arylsulfonate from Ciba Geigy converted into acid form by passing through an ion exchange column;
SYLOID ™ 72 = a silica from Grace;
SERVOXYL ™ VPDZ 3/100 = a mono [isotridecyl polyglycolether (3 EO)] phosphate, from SERVO DELDEN B.V.;
SERVOXYL ® VPAZ 100 = a mixture of monolauryl and dilauryl phosphate, from SERVO DELDEN B.V.,
MICROACE TALC P3 = an Indian talc from NIPPON TALC;
RILANIT ™ GMS = a glycerine monotallow acid ester, from HENKEL AG
TMOS = tetramethylorthosilicate hydrolyzed in the presence of methanesulfonic acid.

COMPARATIVE EXAMPLES 1 TO 8 AND INVENTION EXAMPLES 1 to 19

Influence on Aggregation of Silver Nano-particles of Compounds According to Formulae (I) and (II)

A screening method was developed using a silver hydrosol, which was prepared 20 to 30 minutes before the compounds according to formulae (I) and (II) were screened. 1 mL of a 0.001M solution of the compound being screened was then added to 10 mL of this yellow silver hydrosol. If the silver hydrosol changed colour within one hour, 10 mL of a 0.5% aqueous gelatin solution was added 10s after this change of colour to prevent further silver aggregation. If no change in colour was observed after 1 hour, the concentration of the compound being screened in the hydrosol was increased from $10^{-4}$ M to $10^{-3}$M. Control experiments were carried out with each batch of silver hydrosol to check its performance with a $10^{-3}$M solution of BOD06, a compound giving immediate aggregation.

It is well known that the absorption of silver nano-particles shifts upon aggregation to ever longer wavelengths with ever increasing aggregate size. This shift is perceived as a change in colour from a very pale yellow colour for 10 nm silver particles to orange to red to purple to blue. The degree of aggregation was therefore assessed visually on a scale of 6 levels ranging from ++++ to −−, according to the following criteria:

| | | |
|---|---|---|
| Degree of aggregation of ++++ | = | Strong dark purple-blue colour |
| Degree of aggregation of +++ | = | Dark red to purple colour |
| Degree of aggregation of ++ | = | Red colour |
| Degree of aggregation of + | = | Orange-red colour |
| Degree of aggregation of − | = | Weak orange colour |
| Degree of aggregation of −− | = | No colour change |

The degrees of aggregation obtained with TA-I-1 to TA-I-11, TA-II-1 to TA-II-7, COMP-1 to COMP-3 and BOD01 to BOD05 are given in Table 1 below.

Diffusion Performance of Compounds According to Formulae (I) and (II)

The diffusion experiments were carried out with the surface of a 15 $g/m^2$ layer of S-LEC BL5HP containing the compound being screened in a concentration of 15 mol % with respect to a quantity of silver behenate a quarter of that of the S-LEC BL5HP coverage coated on a glass support in contact with the surface of a 10 $g/m^2$ layer of S-LEC BL5HP containing glutaric acid in a concentration of 24 mol % with respect to a quantity of silver behenate a quarter of that of the S-LEC BL5HP coverage coated on a SERS-probe. In this configuration the SERS-probe was uppermost. The diffusion experiment was carried out by heating the S-LEC BL5HP-coated glass support with the glass support in contact with an electrically heated plate at a temperature of 150° C. for a predetermined time. The configuration was then removed from the heated plate and a Raman spectrum was taken by Dilor XY-laser spectroscopy with the 514 nm line of a Coherent Innova 70C argon/krypton mixed gas laser at 12 mW through the glass plate to ascertain whether the ingredient being screened had diffused to the silver nano-particles in the SERS-probe on the basis of its surface-enhanced Raman spectrum due to contact with silver using the so-called "Surface Enhanced Raman Scattering" (SERS)-effect.

The coated glass support and the coated SERS-probe were prepared by coating the glass support and SERS-probe respectively with a 2-butanone solution of S-LEC BL5HP and the ingredient being screened and glutaric acid respectively, drying at room temperature and finally heating the coated glass support and the coated SERS-probe for 10 minutes at 85° C.

The SERS-probe was prepared by adding an aqueous solution of silver nitrate to an aqueous solution of potassium borohydride and stabilizing the 5 to 10 nm silver nuclei by adding polyvinyl alcohol, the final composition being 0.01M in silver nitrate, 0.015M in potassium borohydride and 1% in polyvinyl alcohol. The resulting silver hydrosol was then added to a solution of gelatin containing a hardener, a biocide, an inorganic pigment and a hardening regulator. The resulting mixture was coated to a dry thickness of 100 nm onto glass plates giving a thin, yellow transparent film containing silver nuclei 5 to 10 nm in diameter. The coated glass plate was then immersed in deionised water at 40° C. for 15 minutes and then in a 0.001M aqueous solution of silver nitrate containing 0.5% of gelatin and 0.001M in ascorbic acid, a reducing agent for silver cations, at 25° C. Electroless deposition of silver occurred on the silver nuclei rather than nucleation of new particle, because nucleation requires much more energy than growth of the silver nuclei already present. Finally the layer containing 90 nm silver particles was rinsed with deionised water and dried. These 90 nm silver particles were required for the laser wavelength used in these experiments (514.5 nm). Other silver particle sizes can be obtained, depending upon the composition of the bath, its temperature and the time of immersion.

Reference Raman spectra were obtained by placing a drop of an aqueous solution of the molecules given in Tables 1 for the particular INVENTION or COMPARATIVE EXAMPLE onto the SERS-probe and measuring the Raman spectrum by Dilor XY-laser spectroscopy with the 514 nm line of a Coherent Innova 70C argon/krypton mixed gas laser at 12 mW measured surface-enhanced as a result of the "Surface Enhanced Raman Scattering" (SERS)-effect with silver.

The diffusion results obtained with TA-I-1 to TA-I-11, TA-II-1 to TA-II-7, COMP-1 to COMP-3 and BOD01 to BOD05 are given in Table 1 below.

TABLE 1

| | | aggregation assessment | aggregation time of silver nano-particles [s] | Diffusion time through BL5HP with glutaric acid at 150° C. [s] |
|---|---|---|---|---|
| Invention example nr. | | | | |
| 1 | TA-I-1 | ++++ | 5 | 120 |
| 2 | TA-I-2 | ++++ | 5 | 120 |
| 3 | TA-I-3 | ++ | 10 | 30 |
| 4 | TA-I-4 | ++++ | 10 | 120 |
| 5 | TA-I-5 | ++++ | 10 | >>120 |
| 6 | TA-I-6 | ++++ | 10 | >>120 |
| 7 | TA-I-7 | +++ | 10 | >>120 |
| 8 | TA-I-8 | ++++ | 10 | >>120 |
| 9 | TA-I-9 | ++++ | 10 | 120 |
| 10 | TA-I-10 | ++++ | 10 | >>120 |
| 11 | TA-I-11 | +++ | 10 | >>120 |
| 12 | TA-II-1 | ++++ | 10 | >>120 |
| 13 | TA-II-2 | ++++ | 10 | 120 |
| 14 | TA-II-3 | ++++ | 10 | 120 |
| 15 | TA-II-4 | +++ | 10 | >>120 |
| 16 | TA-II-5 | +++ | 10 | 120 |
| 17 | TA-II-6 | +++ | 10 | >>120 |
| 18 | TA-II-7 | +++ | 10 | 120 |
| Comparative example nr. | | | | |
| 1 | COMP-1 | −− | >3600 | — |
| 2 | COMP-2 | − | 3600 | — |
| 3 | COMP-3 | − | 3600 | — |
| 4 | BOD01 | +++ | 10 | 5 |
| 5 | BOD02 | ++ | 10 | 30 |
| 6 | BOD03 | + | 10 | 30 |
| 7 | BOD04 | + | 10 | 10 |
| 8 | BOD05 | + | 10 | — |

All of compounds TA-I-1 to TA-I-11 and TA-II-1 to TA-II-7, according to the present invention, produced degrees of silver particle aggregation between ++ and ++++ within 10s and with one exception, TA-I-3, exhibited diffusion times at 150° C. through S-LEC BL5P in the presence of glutaric acid of 120s or more.

Compounds COMP-01 to COMP-03, outside the scope of the present invention, produced either very weak aggregation of silver particles or no aggregation, the diffusion properties not being evaluated.

Compounds BOD01 to BOD05 all belong to the prior art and produced degrees of silver particle aggregation between + and +++ within 10s and exhibited diffusion times at 150° C. through S-LEC BL5HP in the presence of glutaric acid between 5 and 30s, which results in undesirable rapid diffusion to the surface of substantially light-insensitive materials.

COMPARATIVE EXAMPLES 9 TO 15 AND INVENTION EXAMPLES 19 to 35

The substantially light-insensitive thermographic materials of COMPARATIVE EXAMPLES 9 to 15 and INVENTION EXAMPLES 19 to 35 were prepared by coating a dispersion with the following ingredients in 2-butanone onto a 175 μm thick blue-pigmented polyethylene terephthalate support with CIELAB a*- and b*- values of −9.5 and −17.9 respectively subbed on the emulsion-coated side with subbing layer 01 giving layers after drying at 85° C. for 3 minutes in a drying cupboard with the compositions given in Table 2 below.

TABLE 2

| | tonning agent of present invention | | AgBeh cover- | | R01 mol % | R02 mol % | S01 mol % | S02 mol % | S03 mol % | | |
|---|---|---|---|---|---|---|---|---|---|---|---|
| | type | mol % vs AgB | age [g/m$^2$] | BL5HP [g/m$^2$] | vs AgB | vs AgB | vs AgB | vs AgB | vs AgB | VL [g/m$^2$] | Oil [g/m$^2$] |
| Comparative example nr. | | | | | | | | | | | |
| 9 | BOD01 | 15 | 4.15 | 16.6 | 35 | 45 | 24 | 4.91 | 9.84 | 0.19 | 0.037 |
| 10 | BOD02 | 15 | 4.15 | 16.6 | 35 | 45 | 24 | 4.91 | 9.84 | 0.19 | 0.037 |
| 11 | BOD03 | 15 | 4.15 | 16.6 | 35 | 45 | 24 | 4.91 | 9.84 | 0.19 | 0.037 |

TABLE 2-continued

| | tonning agent of present invention | | AgBeh cover- | | R01 mol % | R02 mol % | S01 mol % | S02 mol % | S03 mol % | | |
|---|---|---|---|---|---|---|---|---|---|---|---|
| | type | mol % vs AgB | age [g/m$^2$] | BL5HP [g/m$^2$] | vs AgB | vs AgB | vs AgB | vs AgB | vs AgB | VL [g/m$^2$] | Oil [g/m$^2$] |
| 12 | BOD04 | 15 | 4.15 | 16.6 | 35 | 45 | 24 | 4.91 | 9.84 | 0.19 | 0.037 |
| 13 | BOD01/BOD05 | 5/10 | 4.15 | 16.6 | 35 | 45 | 24 | 4.91 | 9.84 | 0.19 | 0.037 |
| 14 | BOD05 | 15 | 4.15 | 16.6 | 35 | 45 | 24 | 4.91 | 9.84 | 0.19 | 0.037 |
| 15 | — | — | 4.15 | 16.6 | 35 | 45 | 24 | 4.91 | 9.84 | 0.19 | 0.037 |
| Invention example nr | | | | | | | | | | | |
| 19 | TA-I-2 | 15 | 4.15 | 16.6 | 35 | 45 | 24 | 4.91 | 9.84 | 0.19 | 0.037 |
| 20 | TA-I-1 | 15 | 4.15 | 16.6 | 35 | 45 | 24 | 4.91 | 9.84 | 0.19 | 0.037 |
| 21 | TA-I-1/BOD01 | 5/10 | 4.15 | 16.6 | 35 | 45 | 24 | 4.91 | 9.84 | 0.19 | 0.037 |
| 22 | TA-I-2/BOD01 | 5/10 | 4.15 | 16.6 | 35 | 45 | 24 | 4.91 | 9.84 | 0.19 | 0.037 |
| 23 | TA-I-2/BOD01 | 10/5 | 4.15 | 16.6 | 35 | 45 | 24 | 4.91 | 9.84 | 0.19 | 0.037 |
| 24 | TA-I-2/BOD03 | 10/5 | 4.15 | 16.6 | 35 | 45 | 24 | 4.91 | 9.84 | 0.19 | 0.037 |
| 25 | TA-I-2/BOD04 | 5/10 | 4.15 | 16.6 | 35 | 45 | 24 | 4.91 | 9.84 | 0.19 | 0.037 |
| 26 | TA-I-2/BOD04 | 10/5 | 4.15 | 16.6 | 35 | 45 | 24 | 4.91 | 9.84 | 0.19 | 0.037 |
| 27 | TA-I-4 | 15 | 4.15 | 16.6 | 35 | 45 | 24 | 4.91 | 9.84 | 0.19 | 0.037 |
| 28 | TA-I-7 | 15 | 4.15 | 16.6 | 35 | 45 | 24 | 4.91 | 9.84 | 0.19 | 0.037 |
| 29 | TA-I-8 | 15 | 4.15 | 16.6 | 35 | 45 | 24 | 4.91 | 9.84 | 0.19 | 0.037 |
| 30 | TA-II-1 | 15 | 4.15 | 16.6 | 35 | 45 | 24 | 4.91 | 9.84 | 0.19 | 0.037 |
| 31 | TA-II-2 | 15 | 4.15 | 16.6 | 35 | 45 | 24 | 4.91 | 9.84 | 0.19 | 0.037 |
| 32 | TA-II-4 | 15 | 4.15 | 16.6 | 35 | 45 | 24 | 4.91 | 9.84 | 0.19 | 0.037 |
| 33 | TA-II-5 | 15 | 4.15 | 16.6 | 35 | 45 | 24 | 4.91 | 9.84 | 0.19 | 0.037 |
| 34 | TA-II-6 | 15 | 4.15 | 16.6 | 35 | 45 | 24 | 4.91 | 9.84 | 0.19 | 0.037 |
| 35 | TA-II-7 | 15 | 4.15 | 16.6 | 35 | 45 | 24 | 4.91 | 9.84 | 0.19 | 0.037 |

The thermosensitive elements were then coated with an aqueous composition with the following ingredients, which was adjusted to a pH of 3.8 with 1N nitric acid, to a wet layer thickness of 85 μm and then dried at 50° C. for 15 minutes to produce a protective layer with the composition:

| | |
|---|---|
| ERCOL ™ 48 20 = | 2.1 g/m$^2$ |
| LEVASIL ™ VP AC 4055 = | 1.05 g/m$^2$ |
| ULTRAVON ™ W = | 0.075 g/m$^2$ |
| SYLOID ™ 72 = | 0.09 g/m$^2$ |
| SERVOXYL ™ VPDZ 3/100 = | 0.075 g/m$^2$ |
| SERVOXYL ™ VPAZ 100 = | 0.075 g/m$^2$ |
| MICROACE TALC P3 = | 0.045 g/m$^2$ |
| RILANIT ™ GMS = | 0.15 g/m$^2$ |
| TMOS = | 0.87 g/m$^2$ (assuming that the TMOS was completely converted to $SiO_2$) |

After coating the protective layer was hardened by heating the substantially light-insensitive thermographic material at 45° C. for 7 days at a relative humidity of 70%.

Thermographic Printing

The substantially light-insensitive thermographic recording materials of COMPARATIVE EXAMPLES 9 to 15 and INVENTION EXAMPLES 19 to 35 were printed using a DRYSTAR™ 4500 printer from AGFA-GEVAERT with a resolution of 508 dpi which had been modified to operate at a printing speed of 14 mm/s and a line-time of 3.5 ms instead of 7.1 ms and in which the 75 μm long (in the transport direction) and 50 μm wide thermal head resistors were power-modulated to produce different image densities.

Evaluation of Thermographic Properties

The image tone of fresh prints made with the substantially light-insensitive thermographic recording materials of COMPARATIVE EXAMPLES 9 to 15 and INVENTION EXAMPLES 19 to 35 was assessed on the basis of the L*, a* and b* CIELAB-values at optical densities, D, of 1.0 and 2.0 and the results given in Tables 3 to 7.

Assessment of Diffusion of Ingredients and Reaction Products of the Imaging Forming Process to Protective Layer Surface The diffusion of ingredients and reaction products of the imaging forming process to the surface of the protective layer was assessed visually according to a scale of 0 to 5 according to the following criteria:

| | |
|---|---|
| diffusion assessment of 0: | no diffusion |
| diffusion assessment of 1: | first indication of diffusion upon examination under an intense lighting after rubbing with a paper tissue |
| diffusion assessment of 2: | visible in daylight after rubbing with a paper tissue |
| diffusion assessment of 3: | just visible in daylight without rubbing with a paper tissue |
| diffusion assessment of 4: | moderately strong deposition without rubbing with a paper tissue |
| diffusion assessment of 5: | very strong deposition without rubbing with a paper tissue |

The results for printed materials after 3 days at 57° C. and 34% relative humidity are given in Tables 3 to 7 below.

TABLE 3

| | Toning agent | | CIELAB values for fresh prints | | | |
|---|---|---|---|---|---|---|
| | | mol % | for D = 1.0 | | for D = 2.0 | |
| | type | vs AgB | a* | b* | a* | b* |
| Invention Example Nr. | | | | | | |
| 20 | TA-I-1 | 15 | +6.48 | +0.99 | +5.50 | −0.86 |
| 21 | TA-I-1/BOD01 | 5/10 | −3.28 | −9.01 | −1.82 | −5.35 |
| 19 | TA-I-2 | 15 | +10.16 | −0.38 | +11.60 | +0.70 |
| 22 | TA-I-2/BOD01 | 5/10 | −3.35 | −8.94 | −1.58 | −6.32 |
| 23 | TA-I-2/BOD01 | 10/5 | −1.02 | −9.46 | +0.48 | −6.91 |
| Comparative Example nr. | | | | | | |
| 9 | BOD01 | 15 | −3.63 | −8.75 | −2.41 | −5.73 |

The results in Table 3 also show that two combinations of a toning agent, according to the present invention, TA-I-1 and TA-I-2 respectively with a different benzoxazine dione toning agent, BOD01, also surprisingly resulted in a more neutral image tone than would be expected by combining the properties of the two toning agents indicating an unexpected synergetic effect.

TABLE 4

| | Toning agent | | CIELAB values for fresh prints | | | |
|---|---|---|---|---|---|---|
| | | mol % | for D = 1.0 | | for D = 2.0 | |
| | type | vs AgB | a* | b* | a* | b* |
| Invention Example Nr. | | | | | | |
| 19 | TA-I-2 | 15 | +10.16 | −0.40 | +11.60 | +0.70 |
| 24 | TA-I-2/BOD03 | 10/5 | −0.94 | −9.31 | −0.03 | −7.07 |
| Comparative Example nr. | | | | | | |
| 11 | BOD03 | 15 | −1.89 | −6.95 | −1.64 | −3.96 |

The results in Table 4 also show that two combinations of a toning agent, according to the present invention, TA-I-2, with a different benzoxazine dione toning agent, BOD03, also surprisingly resulted in a more neutral image tone than would be expected by combining the properties of the two toning agents indicating an unexpected synergetic effect.

TABLE 5

| | Toning agent | | CIELAB values for fresh prints | | | |
|---|---|---|---|---|---|---|
| | | mol % | for D = 1.0 | | for D = 2.0 | |
| | type | vs AgB | a* | b* | a* | b* |
| Invention Example Nr. | | | | | | |
| 19 | TA-I-2 | 15 | +10.16 | −0.38 | +11.60 | +0.70 |
| 25 | TA-I-2/BOD04 | 5/10 | −2.72 | −7.62 | +0.55 | −5.73 |
| 26 | TA-I-2/BOD04 | 10/5 | −0.49 | −8.46 | +2.33 | −6.13 |

TABLE 5-continued

| | Toning agent | | CIELAB values for fresh prints | | | |
|---|---|---|---|---|---|---|
| | | mol % | for D = 1.0 | | for D = 2.0 | |
| | type | vs AgB | a* | b* | a* | b* |
| Comparative Example nr. | | | | | | |
| 12 | BOD04 | 15 | −4.37 | −5.24 | −2.52 | −3.10 |

The results in Table 5 also show that combinations of a toning agent, according to the present invention, TA-I-2, with a different benzoxazine dione toning agent, BOD04, also surprisingly resulted in a more neutral image tone than would be expected by combining the properties of the two toning agents indicating an unexpected synergetic effect.

TABLE 6

| | Toning agent | | CIELAB values for fresh prints | | | | assessment of post-printing diffusion after |
|---|---|---|---|---|---|---|---|
| | | mol | for D = 1.0 | | for D = 2.0 | | |
| Comparative Example Nr. | type | % vs AgB | a* | b* | a* | b* | 3d/57° C./34% RH |
| 9 | BOD01 | 15 | −3.63 | −8.75 | −2.41 | −5.73 | 5 |
| 13 | BOD01/BOD05 | 5/10 | −3.74 | −6.39 | −1.25 | −4.37 | 5 |
| 14 | BOD05 | 15 | −3.67 | −7.48 | −1.66 | −5.24 | 5 |

The results in Table 6 show that a combinations of two benzoxazine dione toning agents does not exhibit the synergetic more neutral image tone or the synergetic reduction in diffusion exhibited by a combination of toning agents, according to the present invention, and a benzoxazine dione.

TABLE 7

| | Toning agent | | a* CIELAB-values for fresh prints | |
|---|---|---|---|---|
| | type | mol % vs AgB | for D = 1.0 | for D = 2.0 |
| Invention Example Nr. | | | | |
| 20 | TA-I-1 | 15 | +6.48 | +5.50 |
| 19 | TA-I-2 | 15 | +10.16 | +11.60 |
| 27 | TA-I-4 | 15 | +9.41 | +10.16 |
| 28 | TA-I-7 | 15 | +12.85 | +13.97 |
| 29 | TA-I-8 | 15 | +11.03 | +11.60 |
| 30 | TA-II-1 | 15 | +8.68 | +11.86 |
| 31 | TA-II-2 | 15 | +8.88 | +11.54 |
| 32 | TA-II-4 | 15 | +7.56 | +10.78 |
| 33 | TA-II-5 | 15 | +8.19 | +10.05 |
| 34 | TA-II-6 | 15 | +9.32 | +13.20 |
| 35 | TA-II-7 | 15 | +10.33 | +14.21 |
| Comparative Example nr. | | | | |
| 15 | — | — | +11.71 | +14.81 |

The results in Table 7 show that toning agents, according to the present invention, exhibit in a particular thermosensitive element a marginally more neutral image tone. These results do not rule out the possibility that in a different thermosensitive element that the improvement in image tone neutrality could be much greater.

The present invention may include any feature or combination of features disclosed herein either implicitly or explicitly or any generalisation thereof irrespective of whether it relates to the presently claimed invention. In view of the foregoing description it will be evident to a person skilled in the art that various modifications may be made within the scope of the invention.

Having described in detail preferred embodiments of the current invention, it will now be apparent to those skilled in the art that numerous modifications can be made therein without departing from the scope of the invention as defined in the following claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A black and white monosheet substantially light-insensitive thermographic recording material comprising a support and a thermosensitive element, the thermosensitive element comprising a substantially light-insensitive organic silver salt, an organic reducing agent therefor in thermal working relationship therewith, a binder and at least one toning agent, wherein the at least one toning agent is selected from compounds represented by formula (I):

(I)

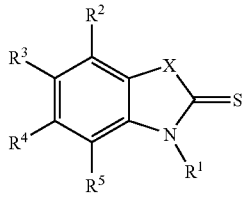

wherein $R^1$ is an alkyl group optionally substituted with a hydroxy, carboxy, carboxy ester, acyl or carbonato group; x is S, O or N—$R^6$; $R^6$ is an optionally substituted alkyl group; $R^2$, $R^3$, $R^4$ and $R^5$ independently represent a hydrogen atom, a halogen atom or an alkyl, an alkoxy, a thio-alkoxy, a nitro, a cyano, a carboxy, a carboxy ester, an acyl, an aldehyde, an acylamido, a sulphonamido, an acylamino, a carbonato, a hydroxy or an aryl group or at least one of $R^2$ and $R^3$, $R^3$ and $R^4$ and $R^4$ and $R^5$ independently represent the atoms necessary to form a carbocyclic or heterocyclic group or at least one of $R^1$ and $R^5$ and $R^2$ and $R^6$ independently represent the atoms necessary to form a heterocyclic ring; and compounds represented by formula (II):

(II)

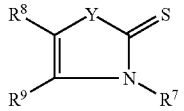

wherein $R^7$is an optionally substituted alkyl group; Y is S, O or N—$R^{10}$; $R^{10}$ is an optionally substituted alkyl group; $R^8$ and $R^9$ independently represent a hydrogen atom, a halogen atom or an alkyl, an alkoxy, a thio-alkoxy, a nitro, a cyano, a carboxy, a carboxy ester, an acyl, an aldehyde, an acylamido, a sulphonamido, an acylamino, a carbonato, a hydroxy or an aryl group or $R^8$ and $R^9$ represent the atoms necessary to form a heterocyclic or a non-aromatic carbocyclic ring or at least one of $R^8$ and $R^{10}$ and $R^9$ and $R^7$ independently represent the atoms necessary to form a heterocyclic ring; and both $R^8$ and $R^9$ cannot both be an alkyl group.

2. The thermographic recording material according to claim 1, wherein said compound(s) represented by formula (I) is (are) selected from the group consisting of:

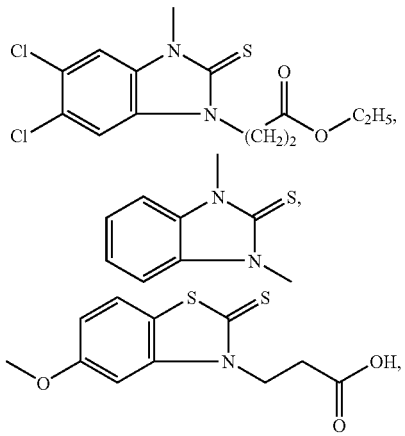

-continued

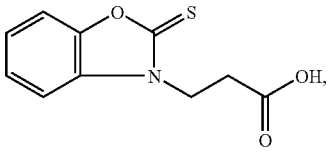

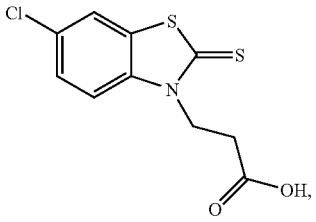

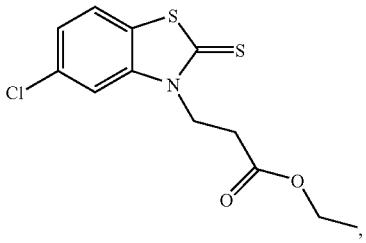

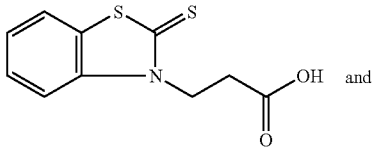

and

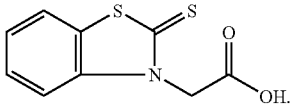

3. The thermographic recording material according to claim 1, wherein said compound(s) represented by formula (II) is (are) selected from the group consisting of:

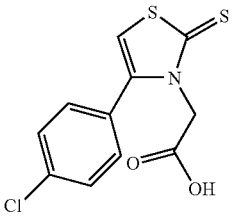

,

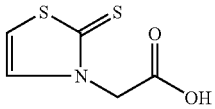

and

-continued

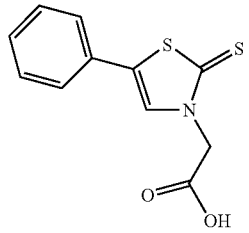

4. The thermographic recording material according to claim 1, wherein said thermosensitive element further comprises at least one toning agent selected from the group consisting of phthalazinone, phthalazinone derivatives, pyridazone, pyridazone derivatives, benzoxazine dione, benzoxazine dione derivatives, naphthoxazine dione and naphthoxazine dione derivatives.

5. The thermographic recording material according to claim 4, wherein said at least one benzoxazine dione derivative is selected from the group consisting of benzo[e][1,3]oxazine-2,4-dione, 7-methyl-benzo[e][1,3]oxazine-2,4-dione, 7-methoxy-benzo[e][1,3]oxazine-2,4-dione, 7-butoxy-benzo[e][1,3]oxazine-2,4-dione, 7-(ethylcarbonato)-benzo[e][1,3]oxazine-2,4-dione,

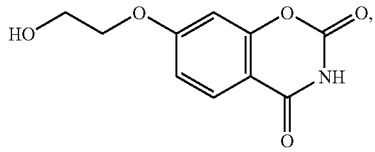

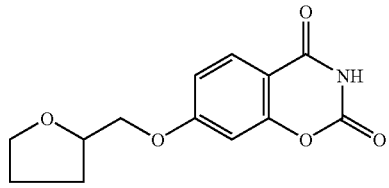

and

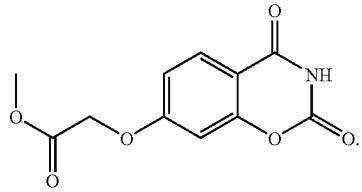

This listing of claims replaces all prior versions, and listings, of claims in the application.

* * * * *